US008703045B2

(12) United States Patent
Mitchell et al.

(10) Patent No.: US 8,703,045 B2
(45) Date of Patent: Apr. 22, 2014

(54) METHOD OF MANUFACTURING A MULTIPLE COMPOSITION COMPONENT

(75) Inventors: Robert J. Mitchell, Derby (GB); Catherine M. F. Rae, Cambridge (GB); Mark C. Hardy, Belper (GB); Shaun R. Holmes, Cambridge (GB)

(73) Assignee: Rolls-Royce PLC, London (GB)

( * ) Notice: Subject to any disclaimer, the term of this patent is extended or adjusted under 35 U.S.C. 154(b) by 699 days.

(21) Appl. No.: 12/946,168

(22) Filed: Nov. 15, 2010

(65) Prior Publication Data

US 2011/0123386 A1 May 26, 2011

(30) Foreign Application Priority Data

Nov. 26, 2009 (GB) ..... 0920697.0

(51) Int. Cl.
*B22F 3/15* (2006.01)
*B22F 7/06* (2006.01)
*B22F 7/08* (2006.01)

(52) U.S. Cl.
USPC ..... 419/6; 419/8; 419/49; 419/54

(58) Field of Classification Search
USPC ..... 419/5–9, 49, 54
See application file for complete search history.

(56) References Cited

U.S. PATENT DOCUMENTS 3,888,663 A 6/1975 Reichman
3,940,268 A 2/1976 Catlin
4,063,939 A 12/1977 Weaver et al.
4,445,259 A 5/1984 Ekbom
4,529,452 A 7/1985 Walker
7,560,065 B2 * 7/2009 Troitski et al. ..... 419/8
2006/0026231 A1 2/2006 Degenhardt et al.

FOREIGN PATENT DOCUMENTS

JP A-5-98316 4/1993

OTHER PUBLICATIONS

Great Britain Search Report issued in Application No. 0920697.0; dated May 5, 2010.
European Search Report issued in European Application No. EP 10 19 1160 dated Feb. 22, 2011.

* cited by examiner

*Primary Examiner* — George Wyszomierski
*Assistant Examiner* — Ngoclan T Mai
(74) *Attorney, Agent, or Firm* — Oliff PLC

(57) ABSTRACT

The present invention relates to a method of manufacturing a multiple composition component 10, comprising: arranging first, second and third constituent parts 40, 30, 42 having first, second and third compositions respectively A, B, C so that the first constituent part 40 shares a first boundary with the second constituent part 30 and the second constituent part 30 shares a second boundary with the third constituent part 40. The first, second and third constituent parts 40, 30, 42 are each either a powder or a solid so that the first and second boundaries are each a solid adjacent to a powder. The arrangement is then processed so as to form a single solid component having first, second and third regions 16, 18, 20 having first, second and third compositions A, B, C respectively.

17 Claims, 6 Drawing Sheets

A-A

B-B

METHOD OF MANUFACTURING A MULTIPLE COMPOSITION COMPONENT

Figure 1:
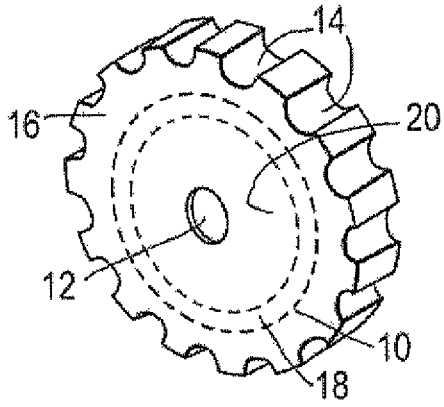

The present invention relates to a method of manufacturing a multiple composition component, in particular, a method of manufacturing a multiple composition component comprising first, second and third constituent parts.

In certain engineering applications it may be desirable to manufacture an integral component comprising a number of different constituent materials (or parts). Such a component will be referred to hereinafter as a multiple composition component.

In gas turbine engines, for instance, turbine blades are mounted on a turbine disk that is mounted on a rotatable shaft. When the engine operates and the shaft rotates, the turbine disk is subject to non-uniform conditions. For example, the temperature that an inner radial portion of the disk is exposed to is lower than the temperature that an outer radial portion of the disk is exposed to.

Turbine disks tend to be made of a Ni-base superalloy. However, there is no known single alloy that provides optimum performance at the non-uniform conditions.

US 2006/026231 A1 discloses a method for manufacturing a turbine disk that is compositionally graded in the radial direction. First and second Ni-base superalloy powders of different compositions are combined in a container and the powders are separated by a hollow cylindrical slip case which is concentric with, but of smaller diameter than, a hollow cylindrical outer container. The first powder is loaded into the inner portion defined by the slip case and the second powder is loaded into the outer portion defined between the slip case and the outer container. The slip case is then removed and the first and second powders are processed to form a single component.

Whilst this method is satisfactory for some applications, there are a number of disadvantages. When the slip case is removed, the first and second powders mix together over a small transition region. If the first and second compositions are significantly different then the interface between the two powders may result in a structural weakness in the final disk. Further, it is essential that the slip case is removed in a clean environment to prevent impurities penetrating between the first and second powders—this may be difficult to achieve.

A further problem is that a new phase, or new phases, and/or carbides and/or oxides may be formed at the interface between the different compositions during the process of manufacturing the multiple composition component or during the heat treatment of the multiple composition component. Another problem is that residual stresses may be formed at the interface between the different compositions in a multiple composition component. The new phase(s) carbides, oxides and residual stresses at the interface between the different compositions arise due to the compositional differences in the multiple composition component.

It is therefore desirable to provide a method of manufacturing a multiple composition component which overcomes at least some of the above problems to at least some extent.

According to a first aspect of the present invention there is provided a method of manufacturing a multiple composition component, comprising: arranging first, second and third constituent parts having first, second and third compositions respectively so that the first constituent part shares a first boundary with the second constituent part and the second constituent part shares a second boundary with the third constituent part; wherein the first, second and third constituent parts are each either a powder or a solid; and processing so as to form a single solid component having first, second and third regions having the first, second and third compositions respectively, the processing including hot isostatic pressing and/or diffusion bonding, the hot isostatic pressing and/or diffusion bonding comprising hot isostatic pressing at a first temperature for a first predetermined time and hot isostatic pressing at a second temperature for a second predetermined time, wherein the first temperature is less than the second temperature.

The hot isostatic pressing may comprise hot isostatic pressing at a first temperature of 850° C. to 1000° C. and applying a pressure of 100 MPa for 4 hours and hot isostatic pressing at a second temperature of 50° C. below the gamma prime solvus temperature of the composition which has the lowest volume fraction of gamma prime phase and applying a pressure of 100 MPa for 2 hours.

At least one of the first and second boundaries is a solid adjacent to a powder. The first and second boundaries may each be a solid adjacent to a powder.

The first and/or secondary boundary may be annular.

In one embodiment the first and third constituent parts are powders, and the second constituent part is a solid. In another embodiment the first and third constituent parts are solids, and the second constituent part is a powder. In a further embodiment the first and second constituent parts are solid, and the third constituent part is a powder. In a further embodiment the first and second constituent parts are powder, and the first constituent part is a solid.

Preferably the second composition is compatible with the first and third compositions. The second composition has a similar gamma phase composition to the gamma phase composition of the first composition and the gamma phase composition of the third composition and the volume fraction of the precipitation strengthening gamma prime phase of the second composition is between the volume fraction of the gamma prime phase of the first composition and volume fraction of the gamma prime phase of the third composition. The second composition may be a mixture of the first and third compositions. The second composition may be the same as the first or third composition. The second composition may be a pure element which is the same as an element present in the first or third composition.

Preferably the first, second and third constituent parts are metal alloys.

The first, second and third constituent parts may be arranged in a container during manufacture. The first and/or secondary boundary may comprise a mechanical interlock between a solid and a powder. The component may be a turbine disk, a compressor disk a fan disk, a bladed disk, a bladed ring, a bladed drum or a casing.

The invention also concerns a multiple composition component, such as a turbine, compressor or fan disk formed by a method according to any statement herein.

According to another aspect of the present invention there is provided a method of manufacturing a multiple composition component, comprising the steps of: dividing a container into first and second compartments using a divider; loading a first powder of a first composition into the first compartment and loading a second powder of a third composition into the second compartment; and processing so as to form a single solid component; wherein the divider has a second composition that is compatible with the first and third compositions.

According to yet a further aspect of the present invention there is provided a method of manufacturing a multiple composition component, comprising the steps of: creating a compartment between a first solid of a first composition and a second solid of a third composition; loading a powder into the compartment; and processing so as to form a single solid component; wherein the powder has a second composition that is compatible with the first and third compositions.

The invention may comprise any combination of the features and/or limitations referred to herein, except combinations of such features as are mutually exclusive.

Figure 2:
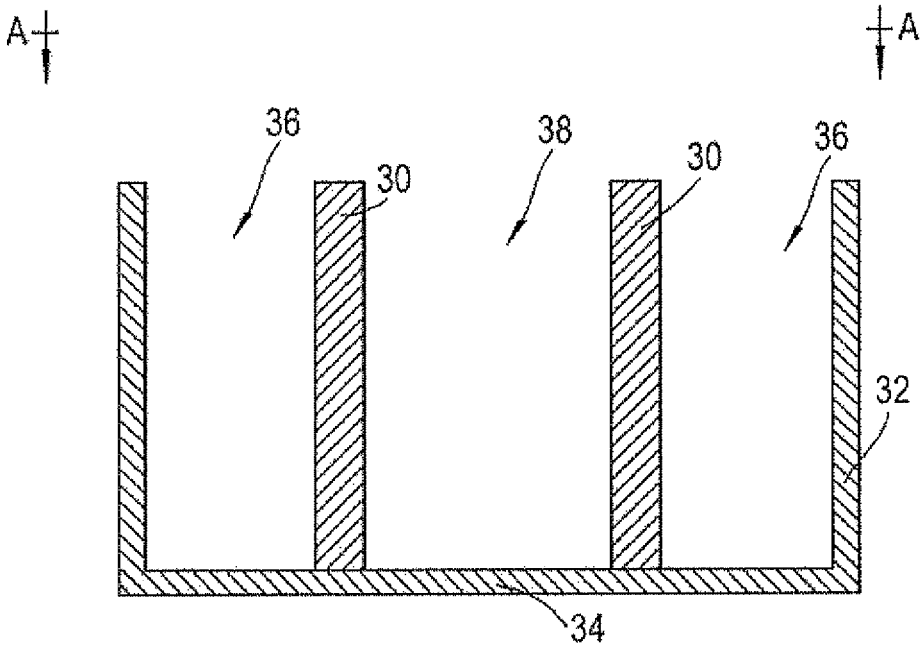
Figure 3:
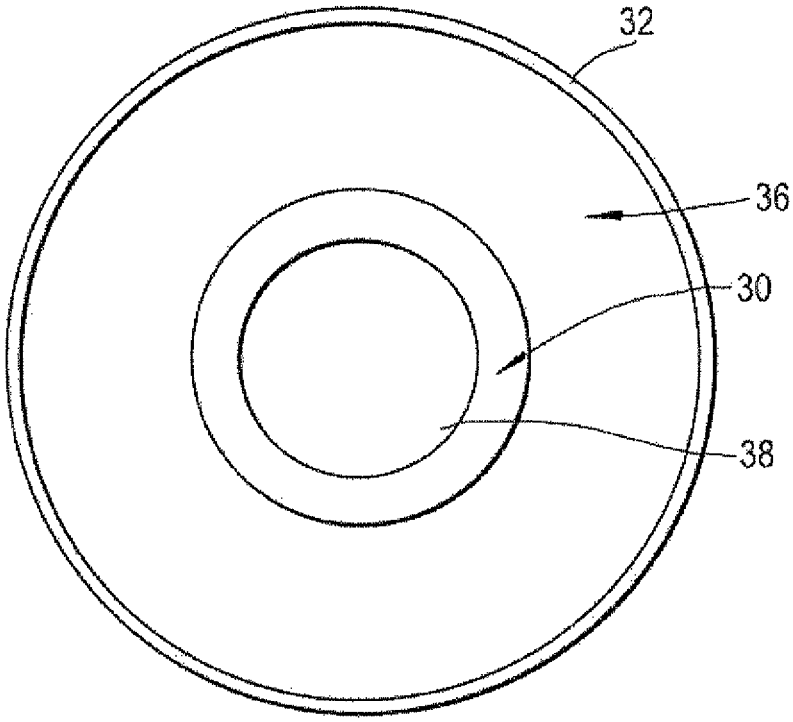
Figure 4:
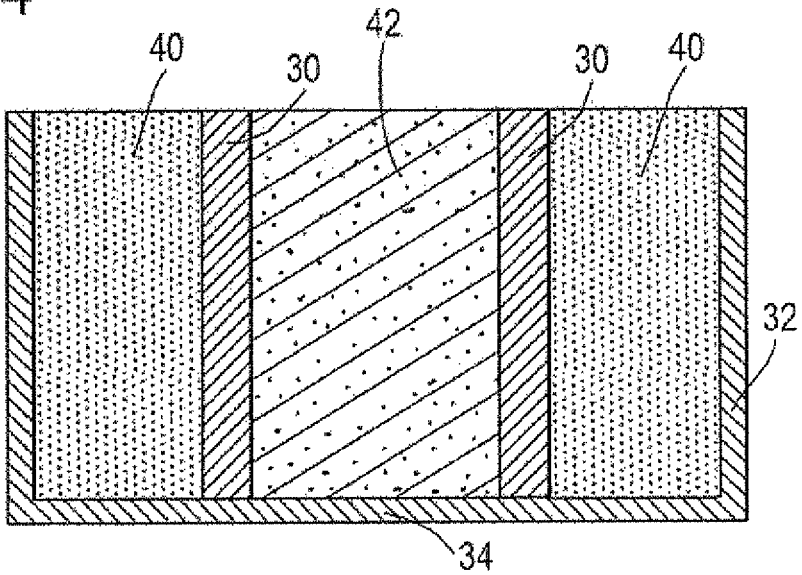
Figure 5:
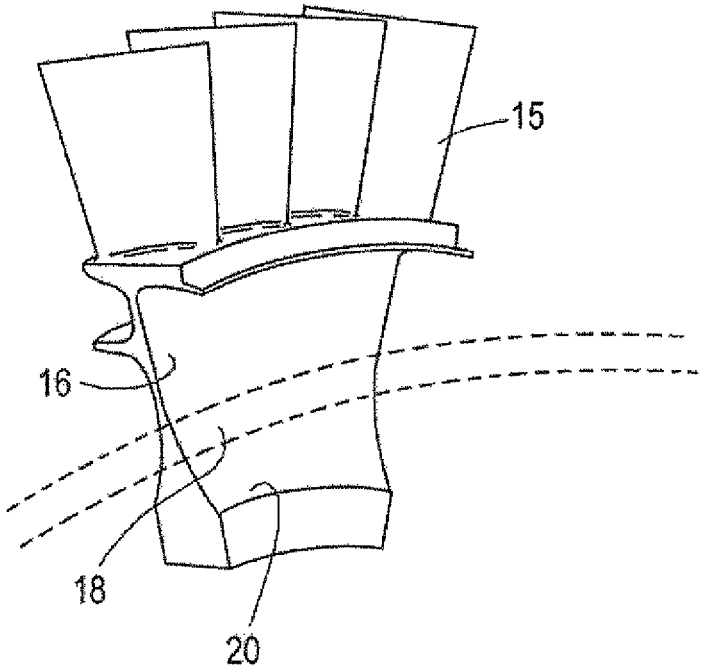
Figure 7:
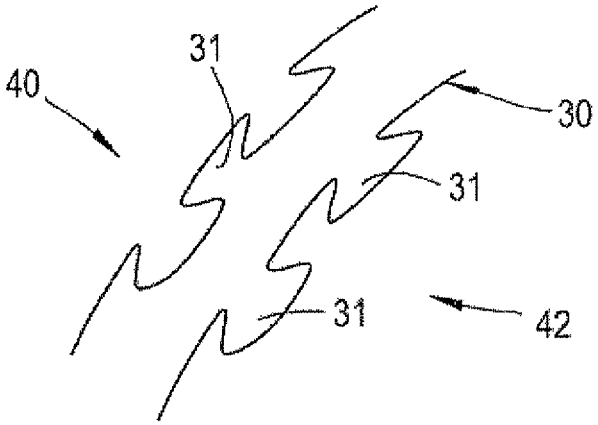
Figure 6A:
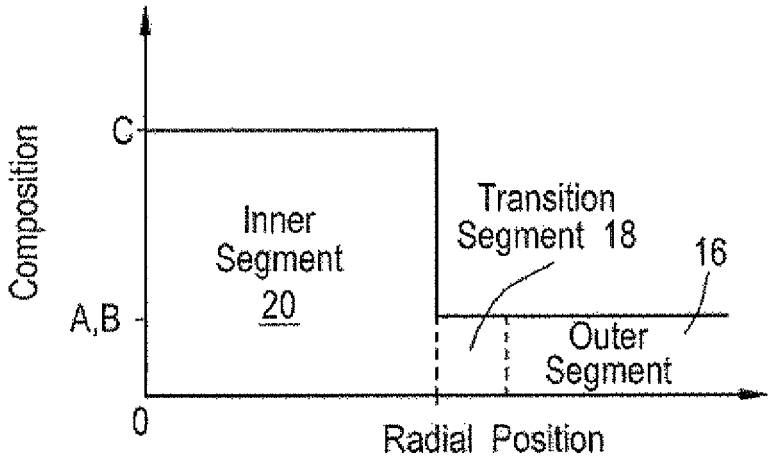
Figure 8:
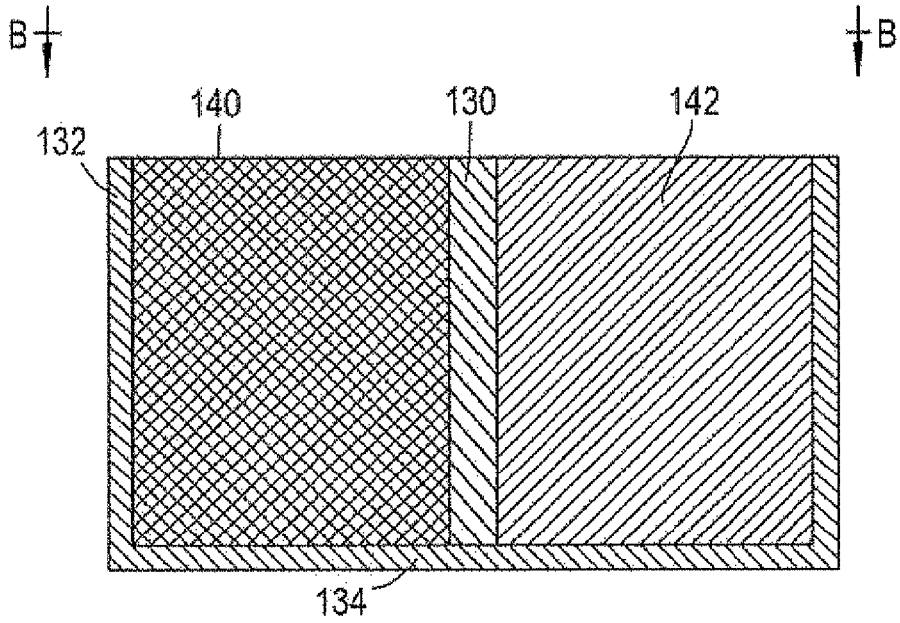
Figure 9:
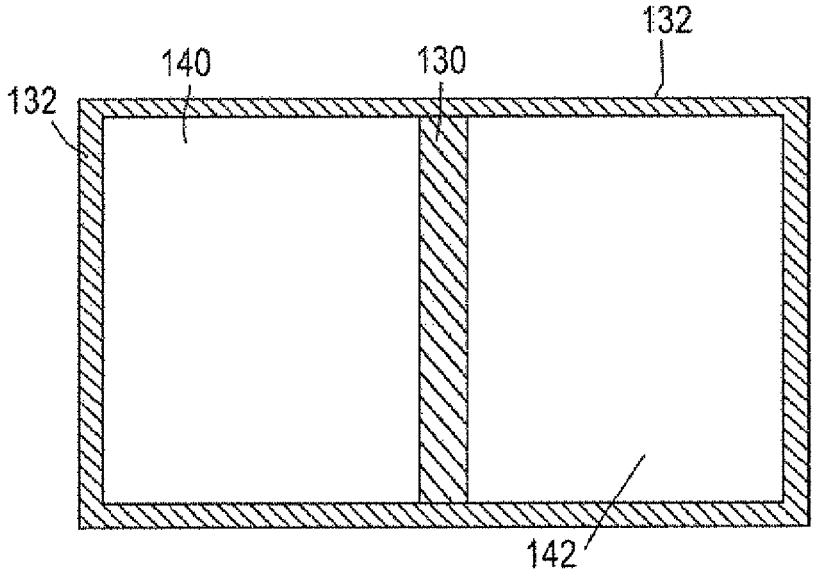
Figure 10:
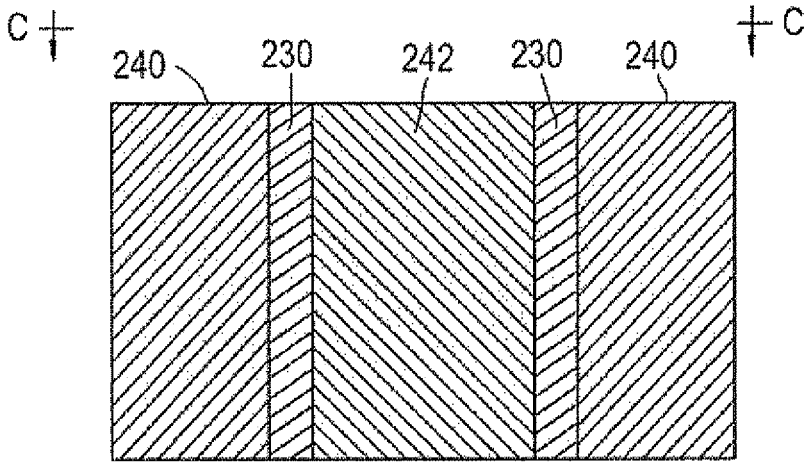
Figure 11:
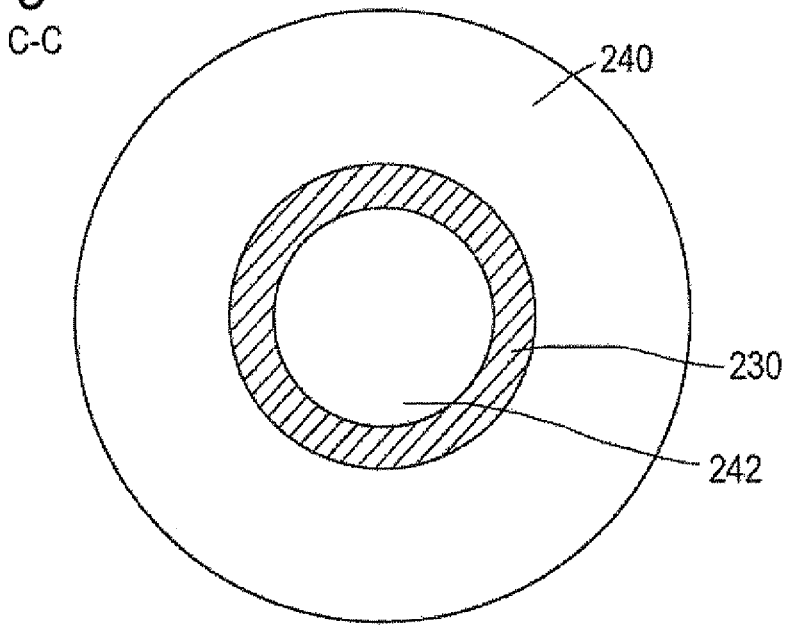

Embodiments of the present invention will now be described, by way of example only, with reference to the accompanying drawings, in which:

FIG. 1 schematically shows a turbine disk;

FIG. 2 schematically shows a cross-sectional view of an arrangement for manufacturing a multiple composition turbine disk;

FIG. 3 schematically shows the view A-A of FIG. 2;

FIG. 4 schematically shows the arrangement of FIG. 2 with first and second powders located within the compartments;

FIG. 5 schematically shows a portion of a blisk manufactured in accordance with the invention;

FIGS. 6A and B shows a graphical representation of the graded composition of the turbine disk;

FIG. 7 schematically shows an alternative divider, for use with the arrangement of FIG. 2;

FIG. 8 schematically shows a cross-sectional view of a further arrangement for manufacturing a multiple composition component;

FIG. 9 schematically shows the view B-B of FIG. 8;

FIG. 10 schematically shows a cross-sectional view of yet a further arrangement for manufacturing a multiple composition component; and FIG. 11 schematically shows the view C-C of FIG. 10.

FIG. 1 shows a multiple alloy turbine disk 10 for a gas turbine engine. The disk 10 has a central hole 12 that allows it to be mounted to a rotatable shaft (not shown). The disk 10 also comprises a plurality of slots 14 that are circumferentially arranged around the outer rim. These slots 14 may be firtree or dovetail shaped such that they can receive a correspondingly shaped root of a turbine blade (not shown).

The disk 10 is made from a number of alloys of different compositions and comprises a first outer annular segment 16, a second transition annular segment 18 and a third inner annular segment 20. The outer annular segment 16 is an alloy of a first composition A, the transition annular segment 18 is an alloy of a second composition B, and the inner annular segment 20 is an alloy of a third composition C.

With reference to FIGS. 2 and 3, the multiple alloy turbine disk 10 can be manufactured according to a first embodiment as follows. A divider 30, in the form of a hollow cylinder, is located concentrically within a cylindrical container 32 having a solid base 34. This defines a first compartment 36 between the container 32 and the divider 30 and a second compartment 38 within the hollow cylindrical divider 30.

Referring now to FIG. 4, a first alloy powder 40 of the first composition A is located within the first compartment 36 and a second alloy powder 42 of the third composition C is located in the second compartment 38. The divider 30 is made from an alloy that has the second composition B that is compatible with the first and third compositions A, C. In this embodiment the second composition B is a mixture of the first and third compositions A, C. The second composition B is therefore metalurgically compatible with the first and third compositions A, C. In other embodiments the second composition is the same as the first or third composition A, C.

A lid is placed on top of the cylindrical container 32. The cylindrical container is degassed and sealed. The non-compacted first and second alloy powders 40, 42 are processed with the divider 30 in place (in other words, the divider 30 is not removed). The processing results in the formation of a solid cylindrical component having first, second and third regions 16, 18, 20 which have the first, second and third compositions A, B, C respectively. In this embodiment the processing is hot isostatic pressing. However, as will be readily apparent to one skilled in the art other suitable processing techniques may be used such as canned extrusion or a combination of techniques. The solid component is subsequently upset forged which increases the diameter of the cylindrical component whilst reducing its length. The component is then heat treated. The heat treatment step may be a spatially variant heat treatment, for example a dual-microstructure heat treatment. The first outer annular segment 16, the second transition annular segment 18 and the third inner annular segment 20 may be heat treated in different ways.

Finally, to produce the desired turbine disk 10 the solid component is machined to form the central hole 12 and the slots 14.

With reference to FIG. 5, the method may be used to form a bladed disk (otherwise known as a blisk). The first composition A of the outer annular region 16 is chosen such that aerofoils 15 can be machined out of this outer region. The aerofoils are machined after the first, second and third compositions have been processed. In other embodiments a bladed ring (bling) or bladed drum (blum) may be manufactured.

Figure 6B:
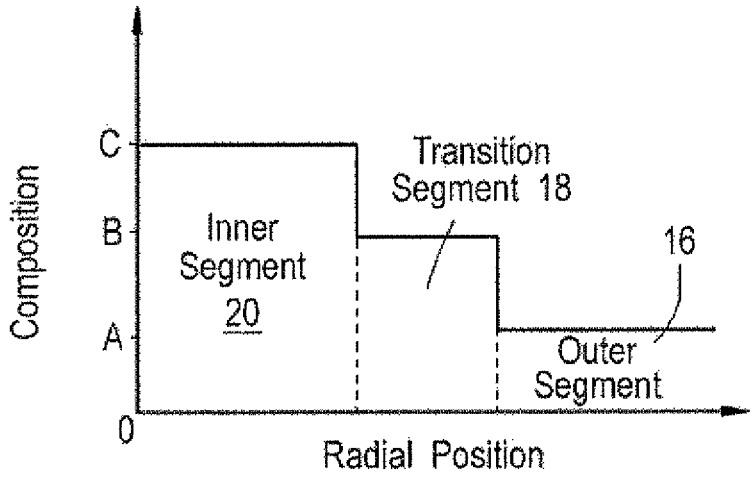

FIGS. 6A and B graphically show the composition of a turbine disk 10 that has been manufactured using dividers 30 having different compositions. In FIG. 6A, the composition B of the divider 30 is identical to that of the first powder A (in other words the first and second compositions A, B are identical). In FIG. 6B, the composition B of the divider 30 is a mixture of the first and third compositions A, C.

Although the above embodiment has described the use of first and second powders 40, 42 and a solid divider 30, as will be readily apparent to one skilled in the art two, or more, dividers could be used with three, or more, powders. This would result in a component having a more gradual compositional gradient.

It may be important to ensure that the divider 30 is clean, this may be done by electro-polishing the divider or by using another suitable method.

Referring to FIG. 7, in an alternative arrangement the divider 30 may have protrusions 31 that in use protrude into the first and second powders 40, 42 to produce a mechanical interlock between the divider 30 and the powders 40, 42.

The method allows for the combination of two or more alloy powders having different solvus temperatures, or different alloys with nominally the same solvus temperature. One of the powders may be chosen such that it has the same nominal solvus temperature as the other powder but has variations in composition that allow for an enhancement in one or more properties. For example, rhenium (Re) may be included in the first alloy powder used for the outer first annular segment 16 in order to improve the creep properties in the rim region of the turbine disk 10. Other additions may include either metallic elements/alloys or non-metallic inclusions to increase properties in selective regions of the disk 10.

The alloy powders used may be conventionally processed Ni-base powder alloys or modified powders that have been pre-treated to enhance certain properties. This may include micro-alloying in which a conventional powder metallurgy alloy is alloyed with a smaller volume fraction (0.5-25%) of another alloy and then combined using the above technique with a powder metallurgy alloy, a Ni-base alloy, or a micro-alloyed powder.

The material of the divider 30 may be chosen to have a composition such that upon heat treatment it produces a midi grain size. For example, it may contain additional grain boundary pinning elements that would restrict grain growth during a conventional supersolvus heat treatment.

The method also allows different powder sizes of the same alloy composition to be combined. For example, a finer powder may be used in the inner segment 20 in order to reduce the size of non-metallic inclusions and a coarser powder (which is less expensive) may be used in the outer segment 16 where the presence of inclusions may be of less importance.

The method is also capable of combining a higher strength, lower temperature powder alloy/micro-alloyed powder with an alloy powder capable of withstanding higher temperatures.

The method described allows for the selective positioning of the powders in the final component. This enables higher cost materials to be utilised in selective regions, where increased performance justifies the increased cost, but which would be uneconomical for use in the throughout the entire component.

The above described method is simpler than previous known methods since the slip case (or divider) does not have to be removed.

Although the above embodiment describes the manufacture of a turbine disk having composition that varies radially, the method may also be used to produce non-circular components that vary in composition in an axial direction, for example.

FIGS. 8 and 9 schematically shows a second alternative manufacturing method for manufacturing a multiple composition component. A first solid block 140 of a first alloy composition A is located in a first end of a rectangular container 132 and a second solid block 142 of a third alloy composition C is located in a second, opposite end of the rectangular container 132. The first and second blocks 140, 142 are spaced from one another so as to form a compartment. An alloy powder 130 of a second composition B is located within the compartment. As with the first embodiment, the second composition B is compatible with the first and third compositions A, C. In this embodiment the second composition is a mixture of the first and third compositions A, C. The second composition is therefore metalurgically compatible with the first and third compositions A, C.

As for the first embodiment, the non-compacted alloy powder 130 is then processed with the first and second blocks 140, 142 in place. The processing results in the formation of a single solid component having three regions of the first, second and third compositions A, B, C. In this embodiment the processing is hot isostatic pressing.

FIGS. 10 and 11 schematically show a third alternative manufacturing method for manufacturing a multiple composition component. A solid annular block 240 of a first alloy composition A is provided and a solid cylindrical block 242 of a third alloy composition C is located within the opening of the annular block 240 such that it is coaxial with it. The diameter of the opening in the annulus 240 is larger than the outer diameter of the cylindrical block 242. There is therefore an annular powder compartment between the annular block 240 and the cylinder 242 which is filled with a powder 230 of a second composition B. As for the first and second embodiments, the second composition B is compatible with the first and third compositions A, C. In this embodiment, the second composition B is a high-temperature alloy.

The non-compacted alloy powder 230 is then processed by diffusion bonding to the annular block 240 and cylindrical block 242, and is then subsequently forged and heat treated.

The described methods may be used to produce either billet or near net-shape components.

The composition difference between the alloys with the first composition A and the third composition C is minimised by providing an alloy with second composition B between the alloy with the first composition A and the alloy with the third composition C. The second composition B is arranged such that the second composition B has a similar gamma phase composition to the gamma phase composition of the first composition A and the gamma phase composition of the third composition C and a volume fraction of the precipitation strengthening gamma prime phase of the second composition B is between, preferably half way between, the volume fraction of the gamma prime phase of the first composition A and the volume fraction of the gamma prime phase of the third composition C. To minimise composition differences across the interfaces between the first composition A and the second composition B and between the second composition B and the third composition C the composition of the gamma phase of the first and third compositions A and C are similar. To minimise residual stresses across the interfaces between the first composition A and the second composition B and between the second composition B and the third composition C the differences between the coefficient of thermal expansion and the elastic modulus of the first, second and third compositions A, B and C are minimised.

The strength and strain tolerance of a solid adjacent a powder interface or a solid adjacent a solid interface are optimised by providing minimum levels of carbon and oxide formers, such as hafnium, zirconium etc, to minimise the propensity for formation of prior particle boundaries that form at interfaces during hot isostatic pressing (HIP). Prior particle boundaries are a network of MC carbides that form on the oxygen rich surfaces of alloy powder particles during hot isostatic pressing (HIP). Prior particle boundaries may be minimised in titanium containing alloys by optimising the hot isostatic pressing (HIP) process. The present invention uses a two stage hot isostatic pressing (HIP) process to minimise the formation of prior particle boundaries. The first stage of the hot isostatic pressing (HIP) is performed by heating to and maintaining at a temperature of 850° C. to 1000° C. and applying a pressure of 100 MPa for 4 hours to precipitate M23C6 carbides in the alloys of the first, second and third compositions A, B and C. Carbon in the first, second and third compositions A, B and C is consumed during the first stage of the hot isostatic pressing (HIP) and therefore there is less carbon available in the first, second and third compositions A, B and C to produce MC carbides on oxygen rich surfaces of the powder particles in the first and third compositions A and C. The second stage of the hot isostatic pressing (HIP) is then performed by heating to and maintaining at a higher temperature of 50° C. below the gamma prime solvus temperature of the composition A, B or C which has the lowest volume fraction of gamma prime phase and applying a pressure of 100 MPa for 2 hours. At the higher temperature used in the second stage of the hot isostatic pressing (HIP) process the M23C6 carbide is taken into solution in the first, second and third compositions A, B and C, but the precipitation of MC carbide at the powder particle boundaries is reduced.

After the hot isostatic pressing (HIP) the multiple composition component may be extruded at a temperature of 50° C. to 100° C. below the gamma prime solvus temperature of the composition A, B or C which has the lowest volume fraction of gamma prime phase. The reduction ratio during extrusion is arranged to ensure adequate re-crystallisation of the constituents to achieve a grain size of less than 5 micrometers. The extruded component produced during the extrusion process may be termed a billet. The billet may be cut into segments and each segment may be isothermally forged. The segments of the billet are isothermally forged at a temperature of 50° C. to 100° C. below the gamma prime solvus temperature of the composition A, B or C which has the lowest volume fraction of gamma prime phase at a low strain rate, typically less than $10^{-2}$ $s^{-1}$ to promote superplastic working.

The first composition A and the third composition C may show differences in the volume fraction of precipitation strengthening gamma prime phase. To optimise mechanical properties the solution heat treatment is conducted at different temperatures. In the case of a disk 10, the third composition C in the inner annular segment 20 is arranged to have a lower volume fraction of gamma prime phase than the volume fraction of gamma prime phase in the first composition A in the outer annular segment 16 and the third composition C is heat treated at a lower temperature than the first composition A. Thus during the solution heat treatment a thermal gradient is applied, radially, across the multiple composition component disk 10.

As an example of a disk 10 the third composition C is a nickel alloy powder consisting of 15 wt % Cr, 18.5 wt % Co, 5 wt % Mo, 3 wt % Al, 3.6 wt % Ti, 2 wt % Ta, 0.5 wt % Hf, 0.027 wt % C, 0.02 wt % B, 0.06 wt % Zr and the balance Ni plus incidental impurities. The third composition C comprises 48 vol % gamma prime phase at 20° C. The gamma phase mainly contains Ni, Cr, Co and Mo. The gamma prime phase mainly contains Ni, Al, Ti and Ta. The first and/or second composition A and B is a nickel alloy powder, or nickel alloy solid, consisting of 12.3 wt % Cr, 16.5 wt % Co, 4.1 wt % Mo, 3.6 wt % Al, 4.5 wt % Ti, 2.5 wt % Ta, 0.2 wt % Hf, 0.15 wt % C, 0.02 wt % B, 0.06 wt % Zr and the balance Ni plus incidental impurities. The first and/or second composition A and B comprises more than 48 vol % gamma prime phase at 20° C. The gamma phase mainly contains Ni, Cr, Co and Mo. The gamma prime phase mainly contains Ni, Al, Ti and Ta. The higher vol % of gamma prime phase in the first and/or second composition A and B provides higher temperature strength and resistance to creep strain accumulation compared to the composition of the third composition C.

The divider 30 has the second composition B and the divider 30 may be formed from sheet metal, sheet alloy, the sheet metal is rolled to form a cylinder which is welded together at the ends. Alternatively the divider 30 may be formed as a ring by hot compaction of metal, alloy, powder or by hot isostatic pressing of metal, alloy, or may be formed by hot compaction of metal, alloy, powder or by hot isostatic pressing of metal, alloy, and by machining the compacted metal powder to a ring. Another alternative is to machine a ring from solid metal, solid alloy. Although only a single divider 30 with a second composition B has been shown between the first and third compositions A and C, it may be equally possible to provide a number of concentric dividers between the first and third compositions A and C such that each divider has a different composition to provide a more gradual compositional gradient between the first and third compositions A and C.

In FIGS. 10 and 11 the solid annular block 240 of the first alloy composition A may be formed as a ring by hot compaction of metal, alloy, powder or by hot isostatic pressing of metal, alloy, or may be formed by hot compaction of metal, alloy, powder or by hot isostatic pressing of metal, alloy, and by machining the compacted metal powder to a ring. Similarly the solid cylindrical block 242 of the third alloy composition C may be formed as a cylinder by hot compaction of metal, alloy, powder or by hot isostatic pressing of metal, alloy, or may be formed by hot compaction of metal, alloy, powder or by hot isostatic pressing of metal, alloy, and by machining the compacted metal powder to a cylinder.

Alternatively in a further embodiment also with reference to FIGS. 10 and 11 a solid cylindrical block 242 of the third alloy composition C is provided. A layer 230 of the second alloy composition B is applied to the outer annular surface of the solid cylindrical block 242 by any suitable coating technique, for example thermal spraying, up to a suitable thickness, e.g. 1-2 mm. The solid cylindrical block 242 with layer 230 is placed within a cylindrical container having a solid base such that an annular compartment is defined between the layer 230 and the cylindrical container. An alloy powder of the first composition A is placed within the annular compartment and a lid is placed on top of the cylindrical container. The cylindrical container is degassed, sealed, hot isostatically pressed (HIP). The cylindrical container is removed from the multiple composition component by machining and/or using an acid and then the multiple composition component is extruded, isothermally forged and heat treated as mentioned previously.

Alternatively in a further embodiment also with reference to FIGS. 10 and 11 a solid annular block 240 of the first alloy composition A is provided. A layer 230 of the second alloy composition B is applied to the inner annular surface of the solid annular block 240 by any suitable coating technique, for example thermal spraying, up to a suitable thickness, e.g. 1-2 mm. The solid annular block 240 with layer 230 is placed within a cylindrical container having a solid base such that a cylindrical compartment is defined radially within the layer 230. An alloy powder of the third composition C is placed within the cylindrical compartment and a lid is placed on top of the cylindrical container. The cylindrical container is degassed, sealed, hot isostatically pressed (HIP). The cylindrical container is removed from the multiple composition component by machining and/or using an acid and then the multiple composition component is extruded, isothermally forged and heat treated as mentioned previously.

The container in any of the embodiments may be stainless steel.

Although the present invention has been described with reference to manufacturing a multiple composition disk it is also suitable for manufacturing other multiple composition components. The present invention is suitable for manufacturing a casing for a turbomachine, e.g. a gas turbine engine, steam turbine etc, in which the composition of the casing is different at different axial positions along the casing such that alloys with increasing temperature capability are arranged to be axially aligned with increasing temperatures in the gas turbine engine. For example a gas turbine engine casing may comprise constituent parts arranged in axial series Waspaloy®, IN718®, Udimet 720Li® and PE16®, with the Waspaloy and IN718 axially aligned with the combustor of the gas turbine engine and the Udimet 720Li and PE16 axially with the turbine of the gas turbine engine. Waspaloy consists of 19 wt % Cr, 13 wt % Co, 4 wt % Mo, 3 wt % Ti, 1.4 wt % Al and balance Ni plus minor additions and incidental impurities. IN718 consists of 52.5 wt % Ni, 19 wt % Cr, 1 wt % Co, 3 wt % Mo, 5.1 wt % Nb, 0.9 wt % Al and balance Fe plus minor additions and incidental impurities. Udimet 720Li consists of 16 wt % Cr, 15 wt % Co, 3 wt % Mo, 1.25 wt % W, 2.5 wt % Al, 5 wt % Ti and balance Ni plus minor additions and incidental impurities. PE16 consists of 43 wt % Ni+Co, 16.5 wt % Cr, 3.3 wt % Mo, 1.2 wt % Al, 1.2 wt % Ti and balance Ni plus minor additions and incidental impurities.

The present invention is also applicable to manufacturing a multiple composition component in which the first, second and third constituent parts comprises a powder.

The metal, alloy, of the first, second and third constituent parts may comprise nickel, cobalt, iron or titanium alloys.

Finally, although the above method has been described for manufacturing metallic components, it may be used with any other powder types, such as ceramics, to produce non-metallic components.

The invention claimed is:

1. A method of manufacturing a multiple composition component, comprising:

arranging first, second and third constituent parts having first, second and third compositions respectively so that the first constituent part shares a first boundary with the second constituent part and the second constituent part shares a second boundary with the third constituent part; wherein the first, second and third constituent parts comprise superalloys and each superalloy comprises a gamma phase and a gamma prime phase and the three constituent parts are each either a powder or a solid; and processing so as to form a single solid component having first, second and third regions having the first, second and third compositions respectively, the processing including hot isostatic pressing and/or diffusion bonding, the hot isostatic pressing and/or diffusion bonding comprising hot isostatic pressing at a first temperature of 850° C. to 1000° C. and applying a pressure of 100 MPa for 4 hours and hot isostatic pressing at a second temperature of 50° C. below the gamma prime solvus temperature of the composition which has the lowest volume fraction of gamma prime phase and applying a pressure of 100 MPa for 2 hours.

2. A method according to claim 1, wherein at least one of the first and second boundaries is a solid adjacent to a powder.

3. A method according to claim 2, wherein the first and second boundaries are each a solid adjacent to a powder.

4. A method according to claim 1, wherein the first and/or second boundary is annular.

5. A method according to claim 1, wherein the first and third constituent parts are powders, and the second constituent part is a solid.

6. A method according to claim 1, wherein the first and third constituent parts are solids, and the second constituent part is a powder.

7. A method according to claim 1, wherein the first and second constituent parts are powder, and the third constituent part is a solid or the first and second constituent parts are solid and the third constituent part is a powder.

8. A method according to claim 1, wherein the second composition has a similar gamma phase composition to the gamma phase composition of the first composition and the gamma phase composition of the third composition and the volume fraction of the precipitation strengthening gamma prime phase of the second composition is between the volume fraction of the gamma prime phase of the first composition and the volume fraction of the gamma prime phase of the third composition.

9. A method according to claim 1, wherein the second composition is a mixture of the first and third compositions.

10. A method according to claim 1, wherein the second composition is the same as the first or third composition.

11. A method according to claim 1, wherein the second composition is a pure element which is the same as an element present in the first or third composition.

12. A method according to claim 1, wherein the component is selected from the group consisting of a turbine disk, a compressor disk, a fan disk, a bladed disk, a bladed ring, a bladed drum and a casing.

13. A method according to claim 12 wherein the composition of the casing is different at different axial positions along the casing.

14. A method of manufacturing a multiple composition component, comprising:

arranging first, second and third constituent parts having first, second and third compositions respectively so that the first constituent part shares a first boundary with the second constituent part and the second constituent part shares a second boundary with the third constituent part; wherein the first, second and third constituent parts are each either a powder or a solid and the first and/or secondary boundary comprises a mechanical interlock between a solid and a powder, and processing so as to form a single solid component having first, second and third regions having the first, second and third compositions respectively, the processing including hot isostatic pressing and/or diffusion bonding, the hot isostatic pressing and/or diffusion bonding comprising hot isostatic pressing at a first temperature for a first predetermined time and hot isostatic pressing at a second temperature for a second predetermined time, wherein the first temperature is less than the second temperature.

15. A method according to claim 14, wherein the first, second and third constituent parts are metal alloys.

16. A method according to claim 14 wherein the first and third constituent parts are powders and the second constituent part is a solid, the second constituent part has protrusions which protrude into the first and third constituent parts to form mechanical interlocks between the solid and the powder.

17. A method of manufacturing a multiple composition component, comprising:

arranging first, second and third constituent parts having first, second and third compositions respectively so that the first constituent part shares a first boundary with the second constituent part and the second constituent part shares a second boundary with the third constituent part; wherein the first, second and third constituent parts comprise superalloys and each superalloy comprises a gamma phase and a gamma prime phase and the three constituent parts are each either a powder or a solid; and processing so as to form a single solid component having first, second and third regions having the first, second and third compositions respectively, the processing including hot isostatic pressing and/or diffusion bonding, the hot isostatic pressing and/or diffusion bonding comprising hot isostatic pressing at a first temperature for a first predetermined time and hot isostatic pressing at a second temperature for a second predetermined time, wherein the first temperature is less than the second temperature, wherein the second composition has a similar gamma phase composition to the gamma phase composition of the first composition and the gamma phase composition of the third composition and the volume fraction of the precipitation strengthening gamma prime phase of the second composition is between the volume fraction of the gamma prime phase of the first composition and the volume fraction of the gamma prime phase of the third composition.

* * * * *